United States Patent [19]

Förster et al.

[11] 4,254,827

[45] Mar. 10, 1981

[54] END CLOSURE ARRANGEMENT FOR HEAT EXCHANGER ELEMENT

[75] Inventors: Siegfried Förster, Ottenfeld; Manfred Kleemann, Quadrath, both of Fed. Rep. of Germany

[73] Assignee: Kernforschungsanlage Jülich Gesellschaft mit beschränkter Haftung, Jülich, Fed. Rep. of Germany

[21] Appl. No.: 914,187

[22] Filed: Jun. 12, 1978

Related U.S. Application Data

[63] Continuation of Ser. No. 724,727, Sep. 20, 1976, abandoned, which is a continuation of Ser. No. 572,643, Apr. 29, 1975, abandoned.

[30] Foreign Application Priority Data

Apr. 30, 1974 [DE] Fed. Rep. of Germany ..... 2420920

[51] Int. Cl.[2] ..... F28F 3/00

[52] U.S. Cl. ..... 165/166

[58] Field of Search ..... 165/157, 166

[56] References Cited

U.S. PATENT DOCUMENTS

| | | | |
|---|---|---|---|
| 1,688,147 | 10/1928 | Levron | 165/166 |
| 2,019,351 | 10/1935 | LaThruk | 165/165 |
| 2,321,110 | 6/1943 | Shipman | 165/166 |
| 2,462,421 | 2/1949 | Pitt | 165/166 |
| 2,812,165 | 11/1957 | Hammond | 165/166 |
| 2,912,749 | 11/1959 | Bauernfeimd et al. | 165/167 |
| 3,473,604 | 10/1969 | Tiefenbacher | 165/166 |
| 3,727,681 | 4/1973 | Fernandas | 165/166 |
| 3,829,945 | 8/1974 | Kanzler | 165/166 X |

FOREIGN PATENT DOCUMENTS

| | | | |
|---|---|---|---|
| 109057 | 3/1900 | Fed. Rep. of Germany | 165/166 |
| 1601179 | 12/1970 | Fed. Rep. of Germany | 165/166 |
| 205790 | 2/1956 | United Kingdom | 165/166 |

*Primary Examiner*—Samuel Scott
*Assistant Examiner*—Theophil W. Streule, Jr.
*Attorney, Agent, or Firm*—Becker & Becker, Inc.

[57] ABSTRACT

A heat exchanger element, especially of undulating or folded configuration having an end closure thereon in the form of a band shaped in conformity with the heat exchanger element and sealingly connected thereto while the legs of the undulations of the band which face each other are also sealed together. In one form of the invention, the band is spaced from the end of the heat exchanger element and the open ends of the undulations are sealed as with solder.

4 Claims, 5 Drawing Figures

END CLOSURE ARRANGEMENT FOR HEAT EXCHANGER ELEMENT

This is a continuation application of Ser. No. 724-727-Förster, et al filed Sept. 20, 1976, now abandoned, which in turn is a continuation application of Ser. No. 572,643-Förster, et al filed Apr. 29, 1975, now abandoned.

The present invention relates to a closure on the end face for a heat exchanger, the heat exchanger matrix of which, is formed by the folds of a band having a train of uniform folds. The said closure of the train of folds is necessary for mutually sealing the chambers through which the media involved in the heat exchange flow.

A heat exchanger of the above mentioned type has become known in which for a closure at the end face of the chambers of the heat exchanger matrix, two adjacent folds each of a folded sheet metal plate are in pairs welded to each other along angled fold edges. This is disadvantageous because for manufacturing reasons during the manufacture of the heat exchangers a lower limit for the thickness of the metal sheet as well as a lower limit for the distance between the folds has to be maintained so that a desirable increase in the heat transferring surface in a given volume by the employment of a very thin-walled materials and by a reduction in the distance between the folds material limits are set.

It is, therefore, an object of the present invention to provide a closure at the end face for a heat exchanger matrix consisting of a folded band, which heat exchanger will also when employing bands of thin material permit a simplified manufacturing process for connecting the end faces of the train of folds in a gas-tight manner.

These and other objects and advantages of the invention will appear more clearly from the following specification, in connection with the accompanying drawings, in which:

FIG. 4 is a fragmentary perspective view showing communication of the inlet and outlet means with the other flow passages and the final closing by bonding of the closure members.

The closure according to the present invention is characterized primarily in that within the region of each of the two end faces of the trains of folds between the folds there is provided at least one closure band which has the shape of the train of folds and which closes off the end face of the heat exchanger matrix while the thickness of the closure band approximates half the distance between the folds and while the closure band with the adjacent folds of the band of the heat exchanger matrix as well as folds of the closure band which face each other are interconnected in a gas-tight manner. Due to the insertion of a closure band between the folds or due to the insertion of two closure bands on both sides of the folding edges, it will be assured that the intermediate spaces between the folds, which spaces are to be closed in a gas-tight manner, are considerably reduced in size so that a safe closure of the folds at the end faces by welding or soldering will be possible. The heat exchanger matrix is expediently welded by fusion welding while after insertion of the closure bands and clamping-in of the heat exchanger matrix, a simple heating of the end faces to melting temperature of the materials will suffice to obtain a gas-tight seal.

In order to solder the end faces, it is expedient to provide the closure bands on both sides with a film of soldering material. A particular advantage of the closure according to the invention consists in that by the insertion of one or two closure bands, also a thin-walled heat exchanger matrix with a slight distance between the folds can be closed in a proper manner.

According to a further development of the invention, the closure band is bent U-shaped, and extends around the fold edges at the end face.

A further preferred embodiment of the invention consists in that at least one of the closure bands is formed by an edge or fold provided at the fold edges at the end face. In this connection, it is advantageous that on the folded side of the folded band of the heat exchanger matrix only those sides of the folded or edge surfaces have to be interconnected in a gas-tight manner which face each other.

Another advantageous modification of the closure according to the invention consists in that on each of the two end faces of the trains of folds there are provided in spaced relationship to said end faces between said folds two closure bands having the shape of the train of folds while the remaining space between the closure bands and the end face is closed by means of solder or welding material. This closure is particularly suitable for the employment of the dip soldering method in connection with the manufacture of the heat exchanger matrix. In this instance, the closure bands merely serve for preventing solder material from entering the chambers to be closed of the heat exchanger matrix.

Figure 1:
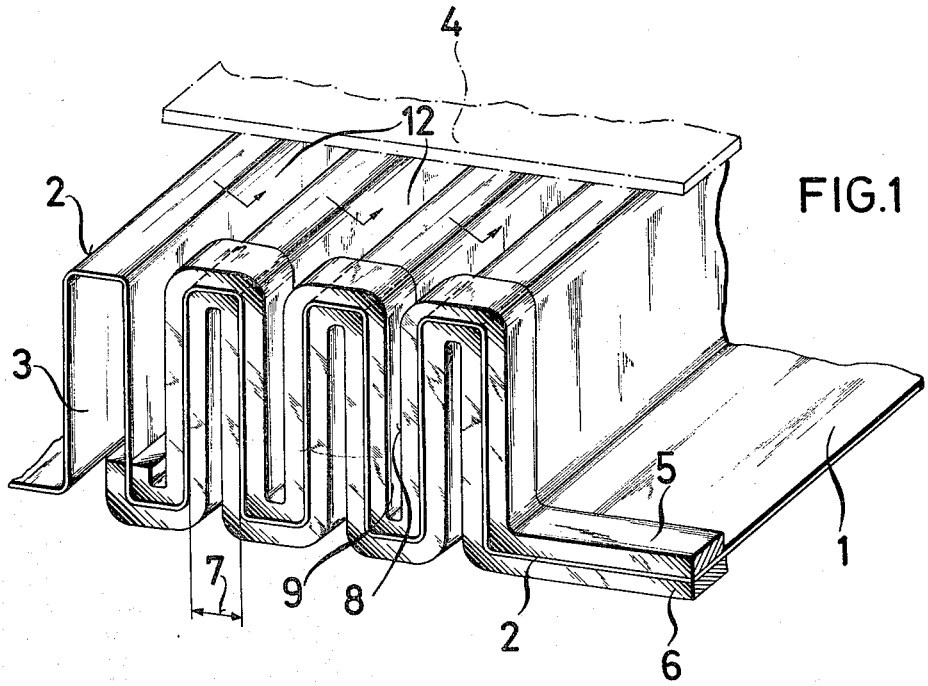
FIG. 1 shows a closure at the end face with two closure bands.

The invention will now be described in detail in connection with the drawings, which for purposes of simplifying the showing, merely illustrate folded parts intended for the manufacture of heat exchangers while only a portion of an end face of the band is shown, the end face in FIGS. 1–3 being shown in a not-yet closed condition. More specifically, the heat exchanger matrix of the heat exchanger of the invention is formed by the folds of a band 1 comprising uniform trains of folds. The edges 2 of the folds at the end face 3 of the train of folds shows a meandering shape. Along said folds there are arranged two walls which cover the train of folds on both sides. The drawing shows only one of the folds 4. For a complete closure of the end faces of the train of folds, the band 1 of the heat exchanger matrix, as shown in FIG. 1, comprises two closure bands 5, 6 which are inserted between the folds, have the shape of the train of folds and are arranged on both sides of the folds. The thickness of the closure bands 5, 6 corresponds approximately to half the distance 7 between the folds.

The closure bands 5, 6 according to FIG. 1 consist of the same metallic material as the band 1 of the heat exchanger matrix. The closure of the end face is effected by fusion welding. However, it is also possible to coat the closure bands 5, 6 on both sides with a film of soldering material and to solder the end faces, while the closure bands 5, 6 are in a gas-tight manner connected to the adjacent folds of the band 1 of the heat exchanger matrix and while also those folds 8, 9 of the closure bands 5, 6 which face each other are interconnected in a gas-tight manner.

Figure 2:
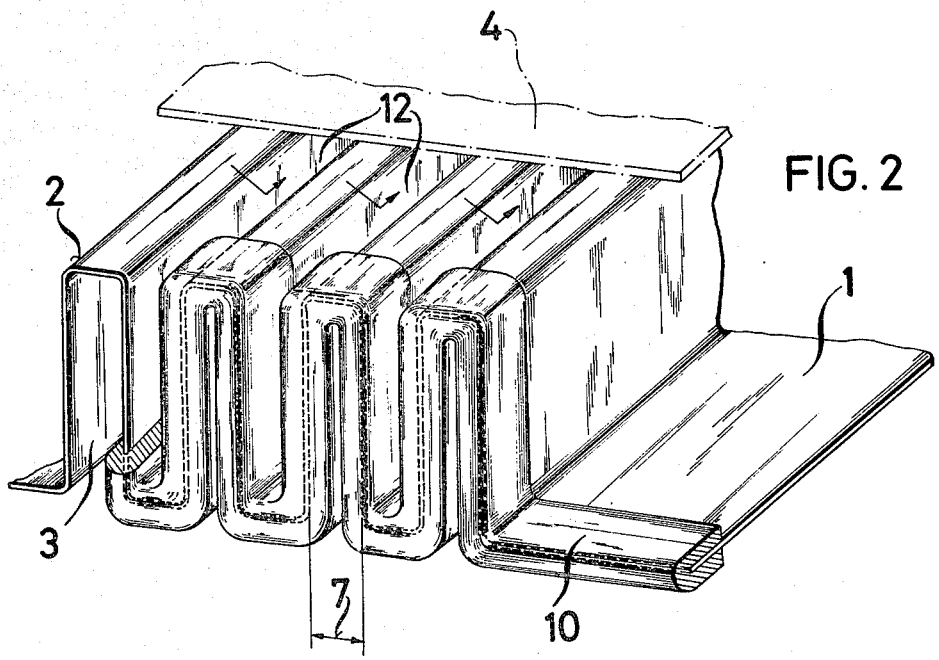
FIG. 2 is a closure at the end face with a U-shaped bent closure band.

The closure bands 5, 6 are, as shown in FIG. 2, replaceable by a U-shaped bent closure band 10 which extends around the folds along their edges 2 at the end face.

Figure 3:
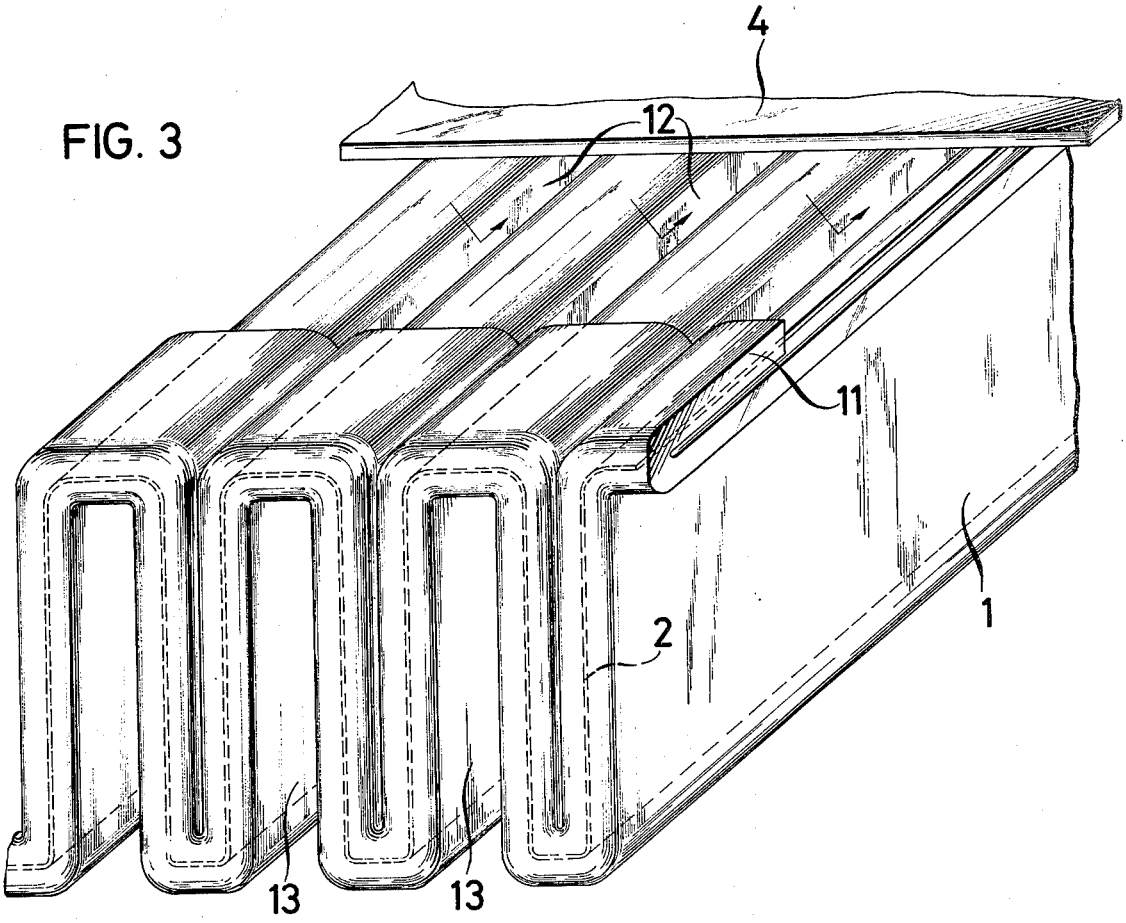
FIG. 3 is a closure at the end face with an edge bent over by 180°.

According to the embodiment of FIG. 3, the closure band consists of a folded-over portion 11 folded over by 180° and located at the edges 2 of the folds at the end face. With this closure of the heat exchanger matrix, it is merely necessary to interconnect those fold surfaces of the folded-over portion 11 which face each other in the embodiment illustrated, only a portion of the folds is closed.

In the drawings, the course of the current of the media involved in the heat exchange as it occurs in the condition of operation of the heat exchanger matrix is indicated by current arrows. The media pass through openings 12 located within the region of the end faces 3 of the heat exchanger matrix, into the hollow chambers between the train of folds while with the closure type of FIG. 3, openings 13 are provided for one of the media at the end faces of the heat exchanger matrix.

Figure 4:
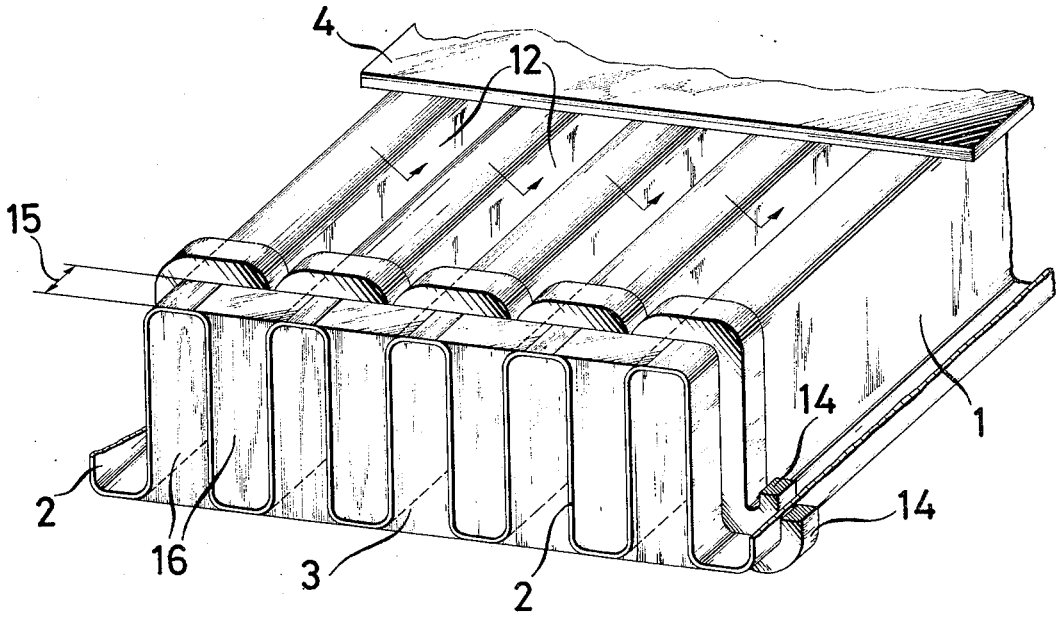
FIG. 4 shows a closure at the end face with closure bands arranged in spaced relationship to the end face.
Figure 5:
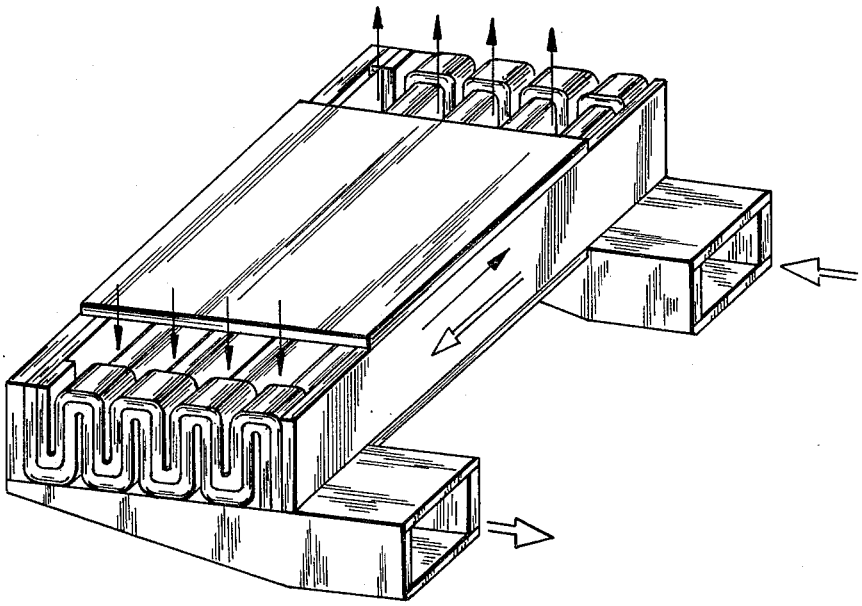
FIG. 5 is a view of the heat exchanger with the manifold and ducts connected thereto.

A variant of the closure according to the invention is shown in FIG. 4. With this embodiment, the closure bands 14 which have the shape of the train of folds are spaced by a distance 15 from the end face 3. Expediently, also the thickness of the closure bands 14 corresponds to half the distance between two folds. That space 16 which from the closure bands 14 to the end face 3 is not filled in is during the manufacture of the heat exchanger matrix closed by soldering material while the closure bands 14 prevent the metal from entering the heat exchanger matrix.

It is, of course, to be understood that the present invention is, by no means, limited to the specific showing in the drawings, but also comprises any modifications within the scope of the appended claims.

What is claimed is:

1. A counterflow heat exchanger having a member which is exposed to individual mediums on opposite sides at high pressure and high temperature, said member having opposite ends and comprising in combination a series of folded portions of U-shaped in cross section thin-walled metallic material between said ends forming separation extending across the member from one of said ends to the opposite end, thereby forming chambers having flow of mediums therethrough, and at least one closure band having a thickness substantially greater than that of said member and approximately half of the spacing between folded portions and also of metallic material and having a meandering shape of the folded portions in conformity with the configuration of said member near a said end thereof and sealingly bonded to one surface of the member at said end, the adjacent convolutions of said band being spaced less than the thickness of said band and bonded together by welding to close the spaces between adjacent convolutions, so as to seal one end of a chamber on one side of said member.

2. A counterflow heat exchanger having a member which is exposed to individual mediums on opposite sides at high pressure and high temperature, said member having opposite ends and comprising in combination a series of folded portions of thin-walled metallic material between said ends forming separation extending across the member from one of said ends to the opposite end, thereby forming chambers having flow of mediums therethrough, and a pair of closure bands of metallic material having a meandering shape of the folded portions in conformity with the configuration of said member near a said end thereof, said bands having a thickness substantially greater than that of said member and approximately half of the spacing between folded portions and being sealingly bonded to opposite surfaces of the member at said end, the adjacent convolutions of each of said two bands being spaced less than the thickness of said band and bonded together by welding to close the spaces between adjacent convolutions of each said two bands to seal the ends of said two chambers on opposite sides of said chamber.

3. A counterflow heat exchanger having a member which is exposed to individual mediums on opposite sides at high pressure and high temperature, said member having opposite ends and comprising in combination a series of folded portions U-shaped in cross section in a corrugated configuration of thin-walled metallic material between said ends forming separation extending across the member from one of said ends to the opposite end, thereby forming chambers having flow of mediums therethrough, and at least one closure band having a thickness substantially greater than that of said member and approximately half of the spacing between folded portions and also of metallic material having a meandering shape of the folded portions in conformity with the corrugated configuration of said member near a said end thereof and sealingly bonded to one surface of the member at said end, the adjacent convolutions of said band being spaced less than the thickness of said band and bonded together by welding to close the space between adjacent convolutions, so as to provide a mating corrugated seal one end of a chamber on one side of said chamber.

4. A counterflow heat exchanger having a member which is exposed to individual mediums on opposite sides at high pressure and high temperature, said member having opposite ends and comprising in combination a series of folded portions in a corrugated configuration of U-shaped in cross section thin-walled metallic material between said ends forming separation extending across the member from one of said ends to the opposite end, thereby forming chambers having flow of mediums therethrough, and a pair of closure bands of metallic material having a meandering shape of the folded portion in conformity with the corrugated configuration of said member near a said end thereof, said bands having a thickness substantially greater than that of said member and approximately half of the spacing between folded portions and being sealingly bonded to opposite surfaces of the member at said end, the adjacent convolutions of each of said two bands being spaced less than the thickness of said band and bonded together by welding to close the spaces between adjacent convolutions of each of said two bands to provide a mating corrugated seal the ends of said two chambers on opposite sides of said member.

* * * * *